US007401961B2

(12) United States Patent
Longatti et al.

(10) Patent No.: US 7,401,961 B2
(45) Date of Patent: Jul. 22, 2008

(54) LUMINOUS WIRE ROPE

(75) Inventors: Bruno Longatti, Stein (CH); Thomas Cantz, Stäfa (CH)

(73) Assignees: Fatzer AG, Romanshorn (CH); Huber + Schner AG, Herisau (CH)

( * ) Notice: Subject to any disclaimer, the term of this patent is extended or adjusted under 35 U.S.C. 154(b) by 0 days.

(21) Appl. No.: 10/426,985

(22) Filed: May 1, 2003

(65) Prior Publication Data

US 2003/0206419 A1 Nov. 6, 2003

(30) Foreign Application Priority Data

May 2, 2002 (CH) ..... 0743/02

(51) Int. Cl.
*F21V 8/00* (2006.01)

(52) U.S. Cl. ..... 362/551; 362/84; 362/806; 362/311

(58) Field of Classification Search ..... 57/243, 57/238, 249, 237, 240; 87/8, 3; 428/364, 428/388; 362/551, 84, 311, 320, 326, 391, 362/806, 34; 174/102 R, 102 E, 106 R, 108, 174/110 R, 113 C; 385/101, 104, 107; 313/498
See application file for complete search history.

(56) References Cited

U.S. PATENT DOCUMENTS 3,798,481 A * 3/1974 Pollara ..... 313/110
3,819,973 A 6/1974 Hosford
RE32,374 E * 3/1987 Dey et al. ..... 385/113
5,333,228 A 7/1994 Kingstone
5,383,100 A * 1/1995 Kikos ..... 362/34
5,485,355 A * 1/1996 Voskoboinik et al. ..... 362/84
5,669,214 A * 9/1997 Kopanakis ..... 57/218
5,753,381 A * 5/1998 Feldman et al. ..... 428/696
5,842,766 A * 12/1998 Scharf, III ..... 362/554
5,876,863 A * 3/1999 Feldman et al. ..... 428/690
5,995,702 A * 11/1999 Tjonneland ..... 385/115
6,169,835 B1 1/2001 Lambert
6,341,550 B1 * 1/2002 White ..... 87/5
6,347,172 B1 2/2002 Keller et al.
6,394,625 B2 * 5/2002 Demaria ..... 362/249

(Continued)

FOREIGN PATENT DOCUMENTS

CH 674967 A5 8/1990

(Continued)

OTHER PUBLICATIONS

Page of Merriam-Webster's Colliegiate Dictionary, 10th ed., copyright 2000.*

*Primary Examiner*—Sharon E Payne
(74) *Attorney, Agent, or Firm*—Alston & Bird LLP

(57) ABSTRACT

In order to improve visibility and hence to reduce the risk of accidents, a load-carrying rope, for example a wire rope, is equipped with a number of luminous elements. A luminous element may in this case assume the position of a wire or of a braid, may be integrated in an insert, or may be guided in the spaces between wires or braids and preferably within the theoretical rope circumference. The luminous element may also itself be composed of luminous elements which are twisted together, spiralled, or laid in so as to form braids. For strain relief, the luminous elements may be equipped with a reinforcement in the form of a strand, or with a mesh.

5 Claims, 4 Drawing Sheets

U.S. PATENT DOCUMENTS

| | | | | |
|---|---|---|---|---|
| 6,742,909 | B2 * | 6/2004 | Conti et al. | 362/84 |
| 6,976,762 | B2 * | 12/2005 | Chien | 362/84 |
| 2002/0011219 | A1 * | 1/2002 | Chien | 119/859 |
| 2002/0039666 | A1 * | 4/2002 | Nakamura | 428/690 |

FOREIGN PATENT DOCUMENTS

| | | | |
|---|---|---|---|
| DE | 4316035 | A1 * | 11/1994 |
| EP | 311751 | A2 * | 4/1989 |
| EP | 0 685 592 | A1 | 12/1995 |
| EP | 1 146 778 | A2 | 10/2001 |
| GB | 2064163 | A * | 11/1979 |
| JP | 1-200388 | A | 8/1989 |
| JP | 10240181 | | 9/1998 |
| JP | 2000120648 | | 4/2000 |
| JP | 2001279587 | | 10/2001 |
| WO | WO 00/13750 | A1 | 3/2000 |
| WO | WO 02/48605 | A2 | 6/2002 |

* cited by examiner

LUMINOUS WIRE ROPE

BACKGROUND OF THE INVENTION

The invention relates to a luminous wire rope which provides improved visibility for safety or aesthetic purposes.

Ropes and, in particular, wire ropes are used in various applications in the form of braided or spiral ropes. Braided ropes are used as conveyor and towing ropes for railroads, as crane and elevator ropes and for other purposes. They are also used as winch ropes for winches, for example for piste vehicles, helicopters, ships, cross-country vehicles and the like.

Braided ropes are composed of braids which are laid in a helical shape around an insert (core), and which are themselves formed by wires. Spiral ropes are used in various embodiments (open, half-closed or fully closed) as supporting, guidance, tensioning or terminal ropes for cable cars, in cable works, in architectural cables and for other purposes. Spiral ropes are composed of wires which are twisted together in a helical shape and laid around an insert, generally a core wire (core). Wire ropes composed of drawn steel wires are of major importance owing to their high load strength with comparatively small cross sections. A wire rope of this type is disclosed, for example, in the document EP-A-685592.

Ropes have the disadvantage that they are difficult to see against a terrain background which can lead to accidents if they are not adequately marked.

A light-emitting rope is known, for example, from the document JP-A-1200388. A luminous effect is accordingly produced by a light-emitting area with phosphorescent pigments and with a further light-emitting area with a reflective structure, at least on the outer surface of the main body of the rope.

A rope which is used as a holding rope and pulling rope and having a light function is known, for example, from the document CH-A-674967. In this case, reflective or self-luminous substances are incorporated in the fibers of the rope by means of a finishing process.

The present invention is in contrast based on the object of providing a rope which avoids the necessity for separate marking or for providing a light in the vicinity, at least at times, during its use.

SUMMARY OF THE INVENTION

The above and other objects and advantages of the invention are achieved by the provision of a load carrying wire rope which comprises at least one luminous element which extends over at least a part of the rope length, and which is configured to be attached to a source which serves to render the element actively luminous in the state when it is fed from the source.

The phrase load-carrying wire rope as used in the present specification and claims is intended to define a rope which is configured to carry a large tensile loading in its application, and is of a class used for example as a conveyor and/or towing rope for railroads, as a crane and/or elevator rope, as a winch rope for winches, helicopters, ships and/or cross country vehicles, and for supporting, guiding, tensioning and/or as a terminal rope for cable cars, in cable works and/or in architectural cables.

The wire rope according to the invention with a luminous element can be seen well against a terrain background, without any need for additional marking or an additional external light source, for example sunlight or ambient light, to stimulate a luminous substance. This makes it possible to largely eliminate any risk of accidents resulting from difficulty in seeing the cable.

The refinement of the wire rope according to the invention may, however, not only contribute to improving visibility (safety aspect) but can also be used for aesthetic purposes. By way of example, wire ropes have become an important structural element for architects—as supporting ropes for fittings, for bracing roofs, as handrails and for many other purposes.

BRIEF DESCRIPTION OF THE DRAWINGS

The invention will be explained in more detail in the following text with reference to the drawings, in which.

DETAILED DESCRIPTION OF THE PREFERRED EMBODIMENTS

Figure 1:
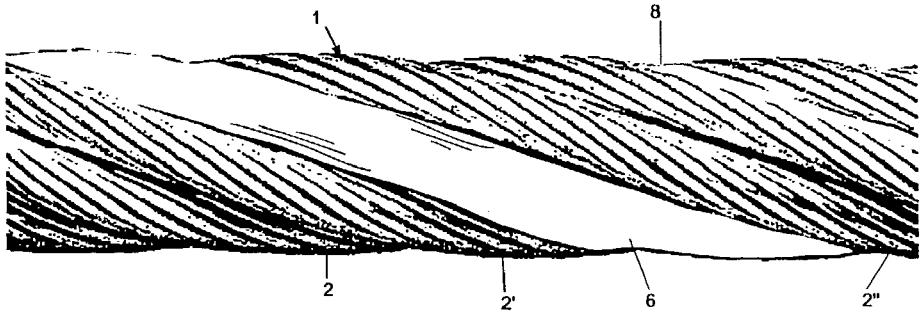
FIG. 1 shows a side view of a part of a braided wire rope according to the invention.

FIG. 1 shows a wire rope 1 which is in the form of a braided wire rope and has two or more wire braids 2, 2', 2" laid in helical shape. The wire braids 2, 2' 2" are each composed of a number of wires, which are twisted together to form a braid. According to the invention, at least one luminous element 6 is provided for example an electroluminescent cable 6', which extends over at least part of the rope length, is laid with the wire braids 2, 2', 2", and can easily be seen on the surface of the braided wire rope 1. Cables such as these are known, for example, from the documents EP-A-1146778 or WO-A-0248605.

In comparison to a conventional rope, this braided wire rope 1 can thus he seen considerably better, in a simple manner. This results in considerable safety improvements.

Figure 2:
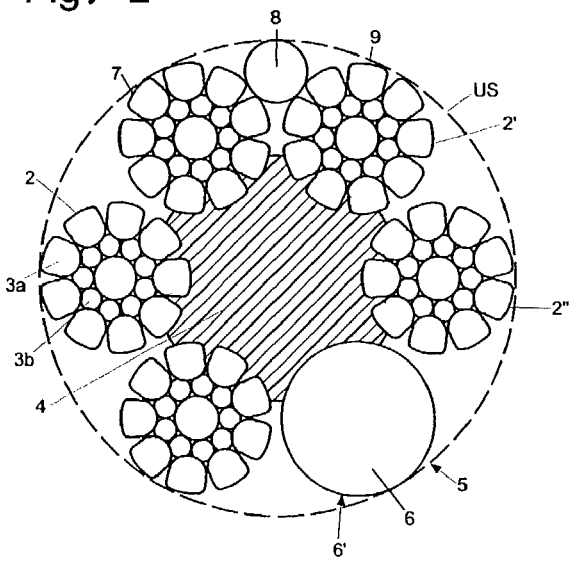
FIG. 2 shows a cross section through the braided wire rope shown in FIG. 1.

As can be seen in particular from FIG. 2, the braided wire rope 1 has five wire braids 2, 2', 2", which are arranged in a circular shape around a core 4 which extends in the longitudinal direction of the rope. In the embodiment shown in FIG. 2, this is a core 4 composed of plastic.

According to the invention, the luminous element 6 is arranged in the position of a sixth braid 5 between the two successive wire braids 2', 2" in the rope circumferential direction, and is laid with the wire braids 2, 2', 2". The wire braids 2, 2', 2" and the luminous element 6 have approximately the same external diameter and are arranged uniformly around the core 4. The luminous element 6, which produces the effect of a light, is an electroluminescent cable 6'.

FIG. 2 shows a further embodiment of a braided wire rope according to the invention. A luminous element 8 is arranged on the braided wire rope 1 and is supported in a space which is located between the theoretical cable circumference $U_s$ and the peripheries of adjacent wire braids 7, 9. In this case, the luminous element 6 could also be replaced by a wire braid corresponding to the braids 2, 2', 2". It is thus possible to arrange luminous elements without reducing the load-carrying capacity of the rope.

Figure 3:
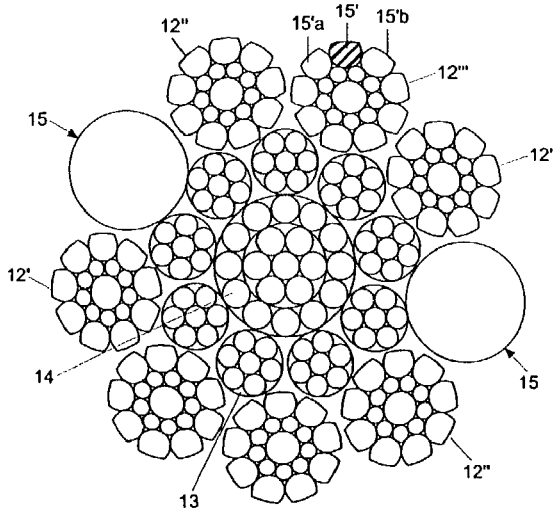
FIG. 3 shows a cross section through a second exemplary embodiment of a possible braided wire rope.

FIG. 3 shows a cross section through a further exemplary embodiment of a possible braided wire rope with a steel core 14, with nine inner wire braids 13 which are arranged in a circular shape around the steel core 14, and with seven outer braids 12', 12", 12'", which are arranged on the rope circumference, as well as two luminous elements 15 in the positions of two outer braids. The luminous elements 15 are in turn laid between in each case two successive wire braids 12', 12" in the rope circumferential direction, with the two luminous elements 15 being arranged essentially opposite one another.

Additionally or as an alternative, a luminous element 15' is twisted together between two wires 15'*a*, 15'*b* of an outer wire braid 12'". This assumes the position of a wire of the wire braid 12'".

Further embodiments of braided ware ropes are also entirely possible, of course, with a different number, configuration and arrangement of conventional wire braid and of the luminous elements which produce the effect of a light, in the positions of braids and/or wires. Particularly in the case of braided wire ropes which do not need to carry large loads, but in fact are used for aesthetic or safety purposes, it would also be possible, for example, to provide two or more luminous elements in positions between two successive wire braids. This embodiment may be used for example, as a handrail in tunnels or for handrails in stairwells.

Figure 4:
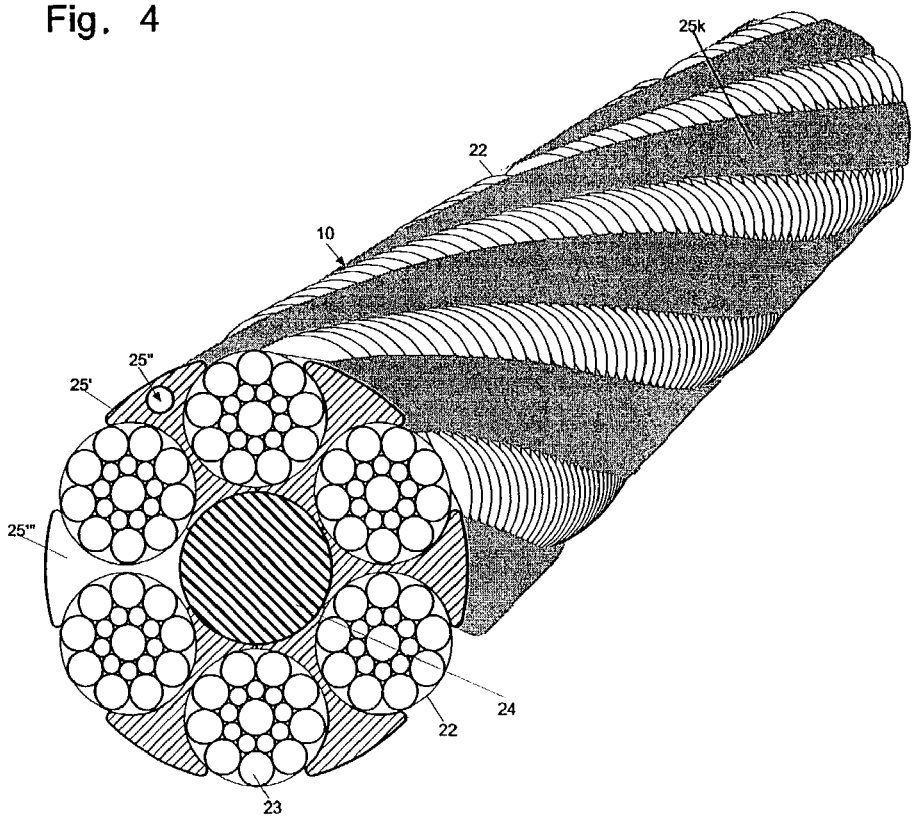
FIG. 4 shows a perspective view of a further embodiment of a braided wire rope according to the invention.
Figure 5:
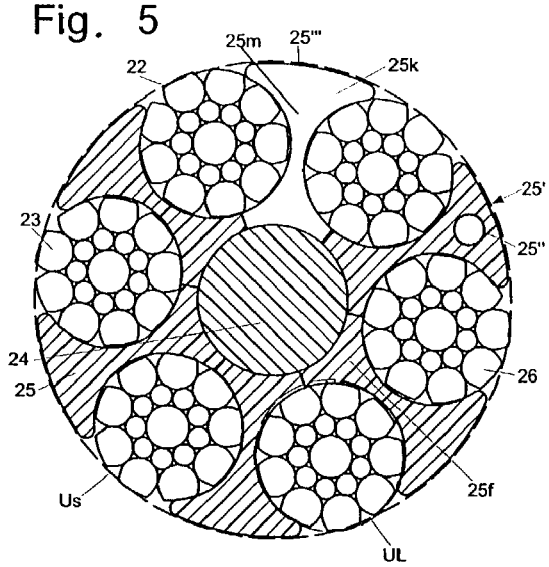
FIG. 5 shows a cross section through the braided wire rope shown in FIG. 4.

A further possible variant of a wire rope 10 according to the invention is illustrated in FIGS. 4 and 5. This wire rope 10, which is once again in the form of a braided wire rope, contains six wire braids 22, each of which comprises nine outer braid wires 23 with the same diameter, and a further ten inner braid wires. The wire braids 22 are arranged in a helical shape around a core 24 which extend in the longitudinal direction of the rope (and is, for example, composed of an elastomer), with profiled inserts 25 being provided between the individual wire braids 22 in this embodiment.

Each insert 25 has a head part 25*k*, which projects as far as the theoretical circumference $U_S$ of the rope, a foot part 25*f* which rests on the core 24, and a center part 25*m* which is located in between. However, it is also possible for the inserts to project beyond the circumference $U_S$ in the radial direction, or to be set back from the circumference $U_S$. The center part 25*m* is provided with two oppositely facing concave cavities 26, whose radii closely correspond to the circumferential radius $U_L$, of the wire braids 22. Other embodiments with parts of the inserts formed in different ways, in terms of both size and shape, are likewise possible. The wire braids 22 which rest in the cavities 26 are held apart from one another by the inserts 25 and are held in their position by the core 24. With one particular refinement of the foot parts 25*f*, there is even no need for the core 24. A wire rope such as this is known, for example, from the document EP-A-685592.

According to the invention, at least one of these inserts 25 which define the position of the wire braids 22 is in the form of a luminous element 25'". The luminous element 25'" comprises in particular at least the head part 25*k* which can be seen on the surface of the rope 10. Some or all of the inserts 25 may also be in the form of luminous elements 25'".

As is shown in FIG. 5, luminous elements may also be integrated in the inserts by guiding a luminous element 25", which is in the form of a wire, in the insert 25'. In this case, the luminous element is in the form of an electroluminescent cable 6'.

Figure 6:
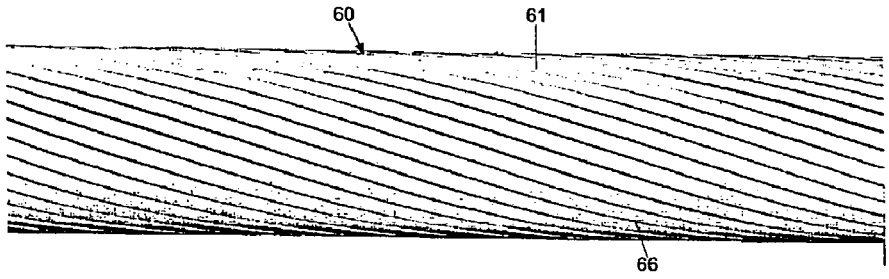
FIG. 6 shows a side view of a part of a fully closed spiral rope according to the invention.
Figure 7:
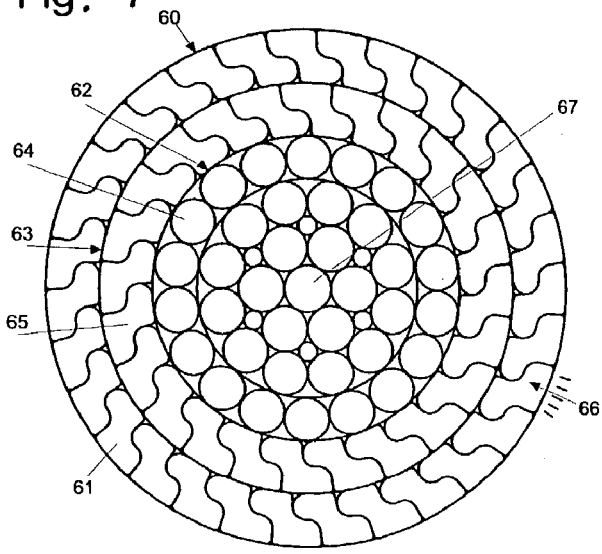
FIG. 7 shows a cross section through the spiral rope shown in FIG. 6.

FIG. 6 and FIG. 7 show a wire rope 60 which is in the form of a spiral rope and in which two or more wire layers 62, 63 are twisted in a helical shape around a core wire 67 or a core braid. Each wire layer 62, 63 is in each case composed of a number of individual wires 64, 65 (round wires, shaped wires such as round and/or I wires or Z wires).

According to the invention, a luminous element 66 is provided, which preferably extends over the length of the rope, is twisted with the outer wires 61, can be seen on the surface of the wire rope 60, produces the effect of a light and is, for example, in the form of an electroluminescent cable 6'. This is Z-shaped, like the other outer wires in the present exemplary embodiment. Two or more luminous elements 66 may, of course, also be twisted with the outer wires 61.

This spiral rope 60 can thus be seen considerably better, in a simple manner, than conventional spiral ropes.

Figure 8:
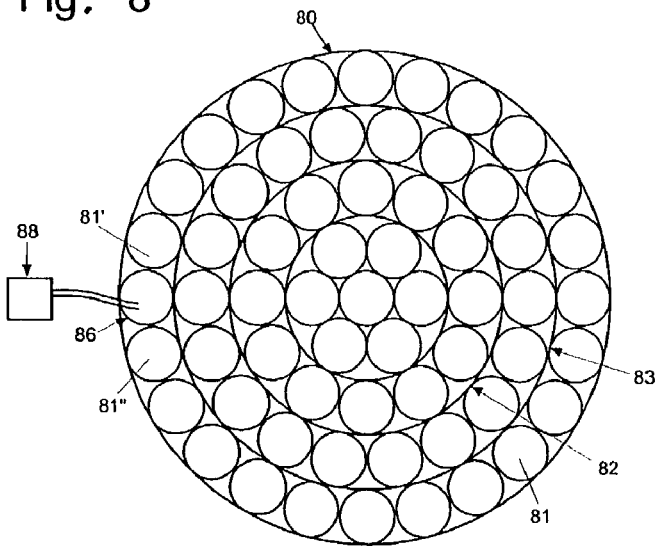
FIG. 8 shows a cross section through a variant of an open spiral rope.

The spiral rope 80 shown in FIG. 8 is a rope such as this with a number of outer wires 81, for example 24 of them, which are arranged on the circumference of a core wire or core braid which extend in the longitudinal direction of the rope, as well as layers 82, 83, located above them, arranged uniformly in a circle.

According to the invention, a luminous element 86 which takes the place of a wire and is twisted together with the wires 81 is arranged between two successive outer wires 81', 81" in the rope circumferential direction. By way of example, this may be an electroluminescent cable light, which is connected to a source 88 in the form of a voltage source, and is actively luminous in the state when it is fed in.

Further embodiments of spiral ropes are, of course, entirely possible, with a different number, embodiment and arrangement of outer wires and different types of luminous elements, whose numbers may also vary, to produce the effect of a light.

Figure 9:
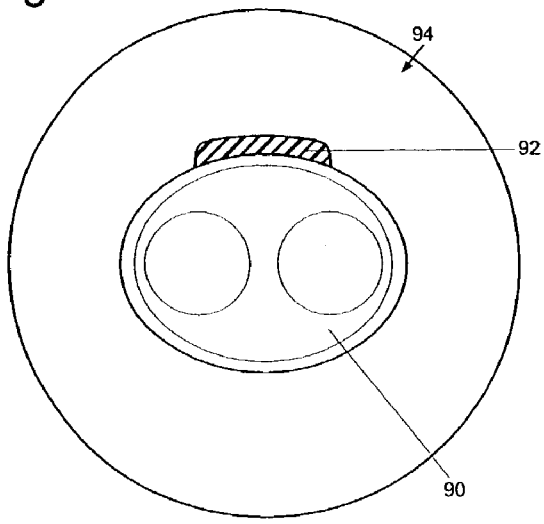
FIG. 9 shows a section through a luminous element with a cable light, strain relief and a plastic sheath.

FIG. 9 shows one particularly suitable embodiment of a luminous element. This is a cable light 90 with a double core, which is provided with kidney-shaped strain relief 92. This combination of the cable light 90 and the strain relief 92 is surrounded by a transparent plastic sheath 94. The strain relief 92 is produced, for example, from armaide, highly stretched polyamide, polyethylene, steel wire, carbon fibers or a glass fiber material. The transparent plastic sheath 94 is used to protect the enclosed elements and, by varying its radial extent, furthermore allows the external diameter of the luminous element to be matched to the external dimensions required for its position, for example instead of a wire or of a braid. The plastic sheath 94 may be colored, in order to use the luminous element to illuminate the rope in the desired color.

Figure 10:
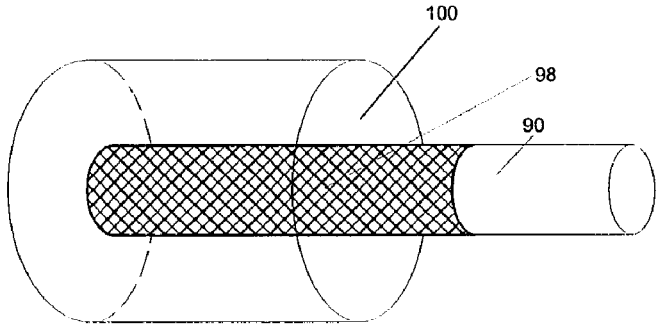
FIG. 10 shows a perspective view of a luminous element with a plastic mesh for strain relief and with a plastic sheath.

The FIG. 10 shows a further embodiment of a luminous element. In this case, a plastic mesh 98 is placed around the cable light 90 with a single core, to provide strain relief. By analogy with the plastic sheeth 94 that is shown in FIG. 9, a transparent sheath, which is annotated 100, composed of plastic is also used in this exemplary embodiment.

Figure 11:
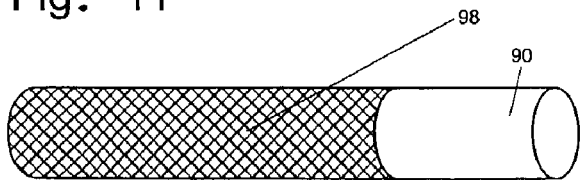
FIG. 11 shows a detail of the plastic mesh from FIG. 10.

FIG. 11 shows a detail of the mesh 98. The mesh 98, which is composed preferably of at least virtually transparent fibers for strain relief, in this case sheaths the cable light 90. When using more absorbent or reflective fibers or wires, the mesh is equipped with a correspondingly coarser mesh pitch and with fewer fibers in order to impede the light emerging from the cable light 90 into the sheath 100 as little as possible. Combinations of transparent and relatively strongly absorbent or reflective fibers or wires may, of course, also be used for the mesh 98.

Particularly in the case of ropes which need to absorb only relatively minor loads and are thus in fact used for aesthetic purposes, it would also be possible, for example, to provide two or more luminous elements in the form of wires. It is also possible to replace all the wires or fibers, braids or yarns as well as strands by luminous elements, preferably by reinforced luminous elements, as is shown in FIGS. 9 to 11. In this case, it is also possible to use luminous elements which are twisted or twisted together to form braids, yarns or strands, once again preferably provided with a reinforcement.

Luminous elements as they have been described in various forms, embodiments and numbers for wire ropes, may also be used for plastic ropes, for example composed of aramide, polypropylene, polyamide or highly stretched polyethylene, such as Spectra® or Dyneema®.

In all the embodiments of ropes with luminous elements, it is possible to achieve the lighting effect of the luminous elements by feeding them from a connected source 88 at any time and depending on the specific requirements at that time. In this case, it would be possible to provide for a continuous feed or else an intermittent feed from a source 88, for example from a voltage source, in order to produce a blinking light effect.

In the case of embodiments which are particularly suitable, the luminous elements, such as the luminous element 8 in FIG. 2, 25" in FIG. 3, 25" in FIG. 4 and FIG. 5, 66 in FIG. 7 and 86 in FIG. 8, may also be in the form of optical waveguides, which emit light at least in places on their surface. These are connected at at least one end to a sources 88, in this case to a light source, which feeds the optical waveguide continuously or intermittently.

Further embodiments are possible which emit light from different ranges of the electromagnetic spectrum, that is to say for example emitting light in different colors. Furthermore, of course, combinations are also possible with passive luminous elements, for example with integrated fluorescent or phosphorescent light-emitting substances. In addition, the light emission can be influenced by suitable elements, for example by reflective coatings.

The ropes according to the invention are preferably designed such that they emit light over their entire length and thus ensure that the rope can be seen well, so that it is possible to eliminate any risk of accidents at many locations without needing to apply any special marking at the dangerous points. It is particularly advantageous that the luminous elements are actively luminous at any time when they are fed, so that their operation is not dependent on factors which can be influenced only to an insufficient extent, such as the ambient light. Furthermore, the ropes according to the invention may also be used to achieve a particular aesthetic effect. Thus, for example, the braced ropes on a rope structure could also be formed using luminous elements such as these.

The invention claimed is:

1. A load-carrying wire rope, comprising a plurality of braids which are helically and uniformly disposed about a central axis, and at least one luminous element which extends over at least a part of the rope length and is configured to be connected to a source, and which is actively luminous in the state when the luminous element is fed from the source, wherein the wire rope further comprises a profiled insert which is arranged between the braids and which includes a head part which can be seen from the outside and extends in a helical shape over the rope length, and wherein the at least one luminous element is integrated in the insert.

2. A load-carrying wire rope, comprising a plurality of braids which are helically and uniformly disposed about a central axis, and at least one luminous element which extends over at least a part of the rope length and is configured to be connected to a source, and which is actively luminous in the state when the luminous element is fed from the source, wherein the at least one luminous element is at least essentially supported in a space which is located between a theoretical rope circumference ($U_s$) and the peripheries of adjacent braids, and wherein the at least one luminous element is an electroluminescent cable light, whose source produces an electrical voltage continuously or intermittently, and thus causes the at least one luminous element to illuminate or blink continuously in a corresponding manner.

3. The load-carrying wire rope as claimed in any one of the claims 1, and 2, wherein the at least one luminous element is itself composed of luminous elements which are twisted together, spiralled, or laid in so as to form a braid.

4. The load-carrying wire rope as claimed in claim 1, wherein the at least one luminous element is an electroluminescent cable light, whose source produces an electrical voltage continuously or intermittently, and thus causes the at least one luminous element to illuminate or blink continuously in a corresponding manner.

5. The load-carrying wire rope as claimed in any one of the claims 1, 2, and 4, wherein the at least one luminous element, for strain relief, is equipped with a reinforcement in the form of a strand or with a mesh, and has a sheath of transparent plastic.

* * * * *